US005480199A

United States Patent [19]

Husting

[11] Patent Number: 5,480,199

[45] Date of Patent: Jan. 2, 1996

[54] DOOR LATCHING AND SEAL ASSEMBLY

[75] Inventor: Thomas J. Husting, Port Washington, Wis.

[73] Assignee: Kohler Co., Kohler, Wis.

[21] Appl. No.: 184,078

[22] Filed: Jan. 18, 1994

[51] Int. Cl.[6] ..... E05C 3/06

[52] U.S. Cl. ..... 292/198; 4/607; 292/303; 292/DIG. 26; 292/DIG. 38

[58] Field of Search ..... 292/80, 303, 341.17, 292/198, DIG. 16, DIG. 38, 198; 49/394; 4/557, 607

[56] References Cited

U.S. PATENT DOCUMENTS

| | | | |
|---|---|---|---|
| D. 320,438 | 10/1991 | Poulson | D23/305 |
| 897,948 | 9/1908 | Windsor | 292/198 |
| 1,226,000 | 5/1917 | Olson . | |
| 1,507,525 | 9/1924 | Stewart | 292/198 |
| 2,687,914 | 8/1954 | Schrum | 49/493.1 |
| 4,856,126 | 8/1989 | Baus | 4/607 |
| 4,882,795 | 11/1989 | Baus | 4/557 |

FOREIGN PATENT DOCUMENTS 3326790 9/1984 Germany .

*Primary Examiner*—Steven N. Meyers
*Assistant Examiner*—Tuyet-Phuong Pham
*Attorney, Agent, or Firm*—Quarles & Brady

[57] ABSTRACT

A door latching and seal assembly wherein a movable seal provides a combined latching and seal function with a detent action as the door engages and disengages a movable seal. In a preferred manner, the assembly has an extending lip for engagement with the door and the detent action is provided by lobe portions extending into cutouts in a mounting member. The latching and seal assembly is particularly suited for use with a curved shower door.

10 Claims, 3 Drawing Sheets

DOOR LATCHING AND SEAL ASSEMBLY

BACKGROUND OF THE INVENTION

A. Field of the Invention

This invention relates primarily to seals for doors. More particularly, the invention relates to a latching seal for a shower door which has a pivotal closing and opening action.

B. Description of the Art

Some types of seal and latching systems for shower doors are well known. These include door jambs with thin short flexible blades which deflect when the door strikes the jamb at 90°.

However, these seal and latching systems do not operate with shower doors which contact the seal area at angles other than 90°. This is a problem where hinged doors are employed in conjunction with neo-angle showers such as shown in U.S. Pat. No. Des. 320,438.

A shower door seal and latching system should preferably not only seal the inside or "wet side" of the door but also move with the door from a receptive position to a closed position. Also preferably, it should be able to release the door and move back to its door receptive position automatically.

In addition, a shower door seal and latching system should be capable of easy assembly and repair. It should also be manufactured from few parts so as to reduce the cost of production.

SUMMARY OF THE INVENTION

In one aspect, the invention provides a door latching seal assembly wherein a mounting member is adapted to be secured to an essentially vertical support. A combined latching and seal member is pivotally attached to the mounting member for contact with a door panel. There are resilient displacement means acting between the mounting member and the latching and seal member to resist pivoting of the latching and seal member away from two distinct positions.

In a preferred embodiment, the resilient displacement means is provided by a detent action.

In another aspect, the resilient displacement means is in part provided by a projecting portion and a receptive compartment reciprocally positioned on the mounting member and the combined latching and seal member. The mounting member and the combined latching and seal member are constructed and arranged to provide a snap apart feature.

In still another aspect, the combined latching and seal member includes a base wall and two side wall members with one of the side wall members extending beyond and toward the other to provide a seal lip.

In another preferred embodiment, the door jamb is a rounded pole and the door panel is curved in horizontal section.

The door latching and seal assembly of this invention affords a tight seal for a shower door. Preferably, it is used for a strike seal area which is in a plane different from the plane in which the pivot point of the assembly is located and thus at an angle other than 90°. It is especially suited for use with rounded shower doors which strike a seal area on a rounded side. The objects of the invention therefore include:

a. providing a door seal which also acts as a latching member;

b. providing a door seal of the foregoing type which can effect a latching and seal in conjunction with a strike area wherein the contact is other than 90°;

c. providing a door seal of the foregoing type which can be manufactured with few parts and thus at reduced costs;

d. providing a door seal of the foregoing type which can be easily installed and maintained; and e. providing a door seal of the foregoing type which can effect a sealing and latching effect for a round shower door in conjunction with a round door jamb.

These and still other objects and advantages of the invention will be apparent from the description which follows. In the detailed description below, the preferred embodiment of the invention will be described with reference to the accompanying drawings. The embodiment does not represent the full scope of the invention. Rather the invention may be employed in other embodiments.

DESCRIPTION OF THE PREFERRED EMBODIMENT

Figure 1:
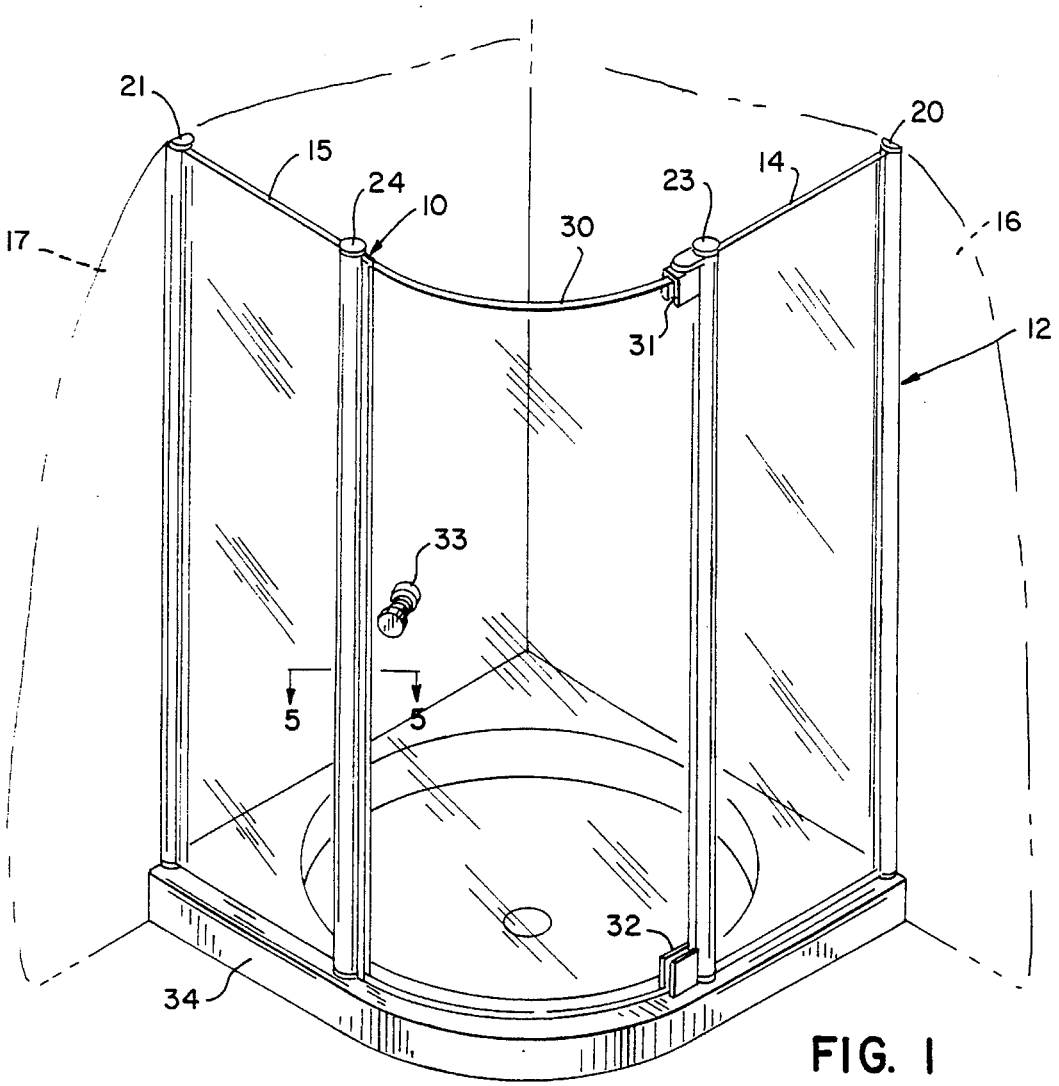
FIG. 1 is a top front perspective view showing a bathing fixture employing the door latching and seal assembly of this invention.
Figure 2:
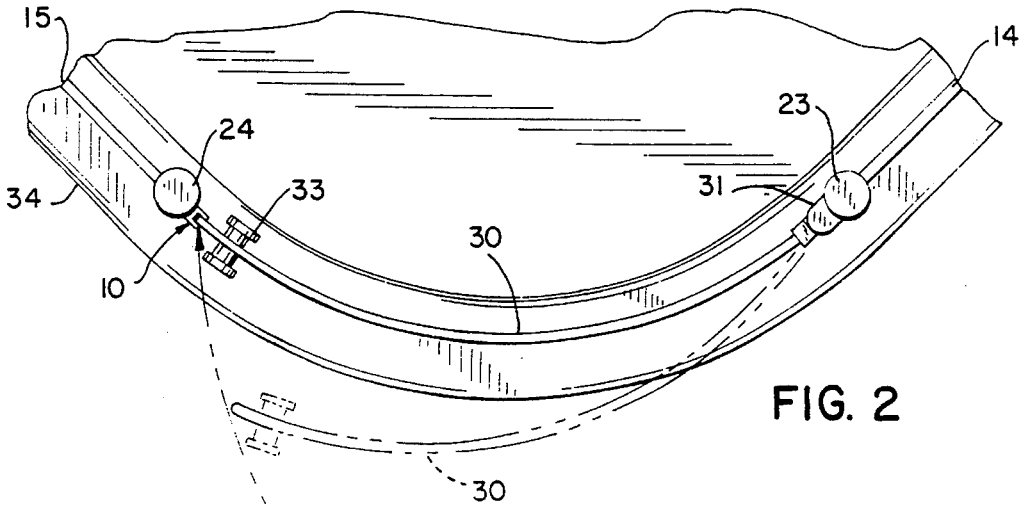
FIG. 2 is a partial top plan view of the bathing fixture shown in FIG. 1.

Referring to FIGS. 1 and 2, the door latching and seal assembly, generally 10, is shown in conjunction with a bathing fixture (e.g. a shower enclosure), generally 12, having side walls 14 and 15 connected to room corner walls 16 and 17 by the wall jambs 20 and 21. The wall jambs 20 and 21 are the subject of a copending patent application entitled "Adjustable Wall Jamb", U.S. Ser. No. 08/184,077, filed Jan. 18, 1994, and is commonly assigned. It is incorporated by reference as if further set forth herein.

Intermediate posts 23 and 24 are also connected to side walls 14 and 15, respectively, with a door 30 being hinged to intermediate post 23 by the hinges 31 and 32. The door engages the latching mechanism 10 on the intermediate post 24. A handle 33 is provided on the door 30, and the enclosure has a receptor base 34.

Figure 3:
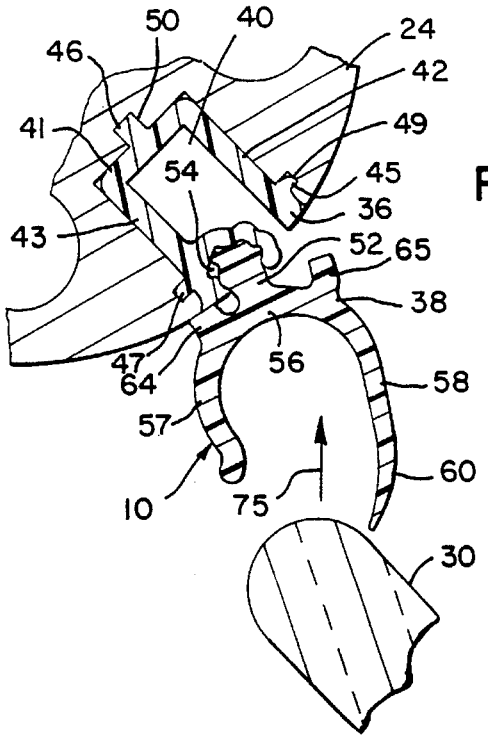
FIGS. 3, 4 and 5 are partial enlarged views illustrating the sequential engagement of the latching seal by the door. The section is taken along line 5—5 of FIG. 1.
Figure 4:
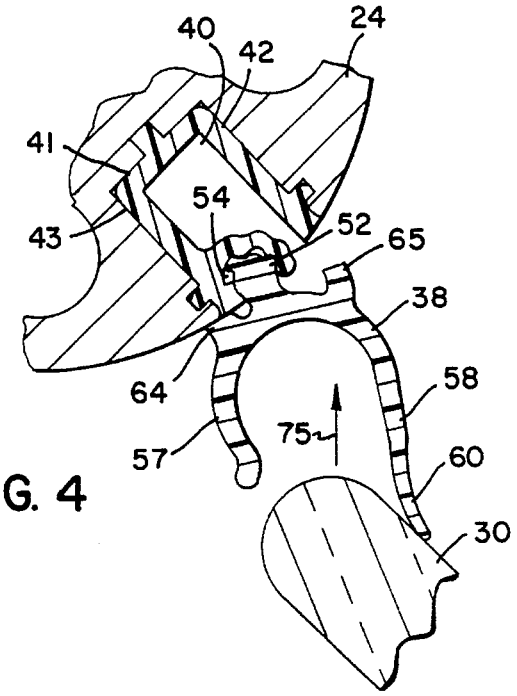
Figure 5:
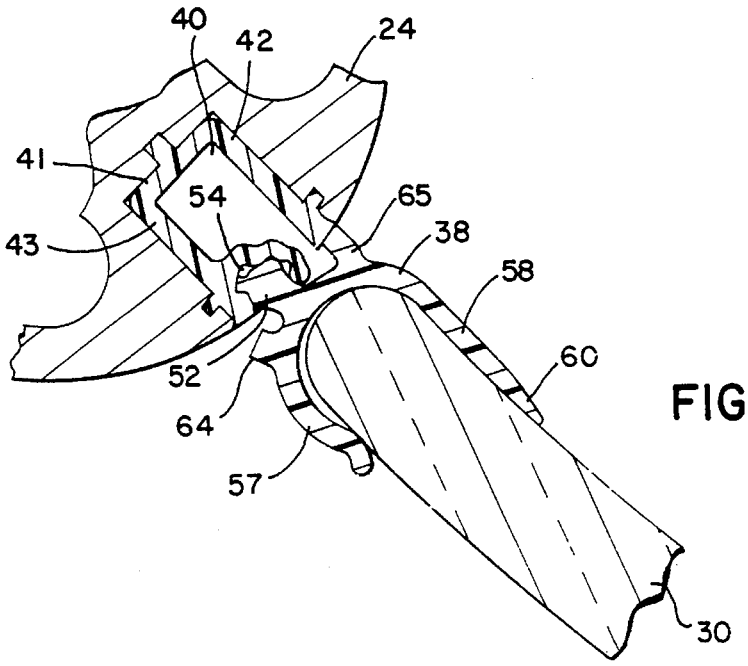

Referring to FIGS. 3, 4 and 5, these illustrate the unique engagement of the door 30 with the door latching and seal assembly 10. There are a stationary mounting member 36 and a latch and seal member 38. A cavity 40 is provided in the intermediate post 24 which receives the walls 41, 42 and 43 of the mounting member 36. Appropriate flanges 45, 46 and 47 are positioned in accommodating slots such as 49 and 50. A projecting somewhat cylindrical portion 52 extends from the latch and seal member 38 and is positioned in a somewhat cylindrical compartment 54 in the mounting member 36. The latch and seal member 38 also has a base wall 56 as well as side walls 57 and 58. A flexible seal lip 60 extends from side wall 58, and the more rigid wall 57 is the latch.

Figure 6:
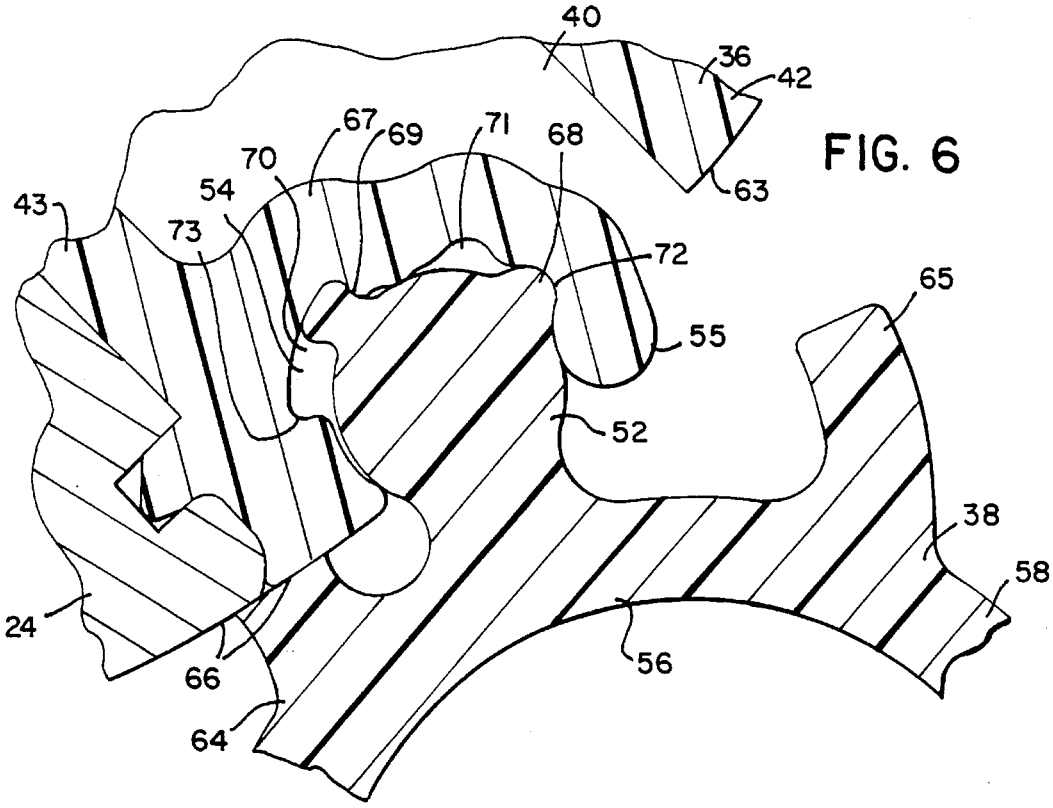
FIGS. 6 and 7 are further enlarged detail views illustrating the detent action of the latching seal.
Figure 7:
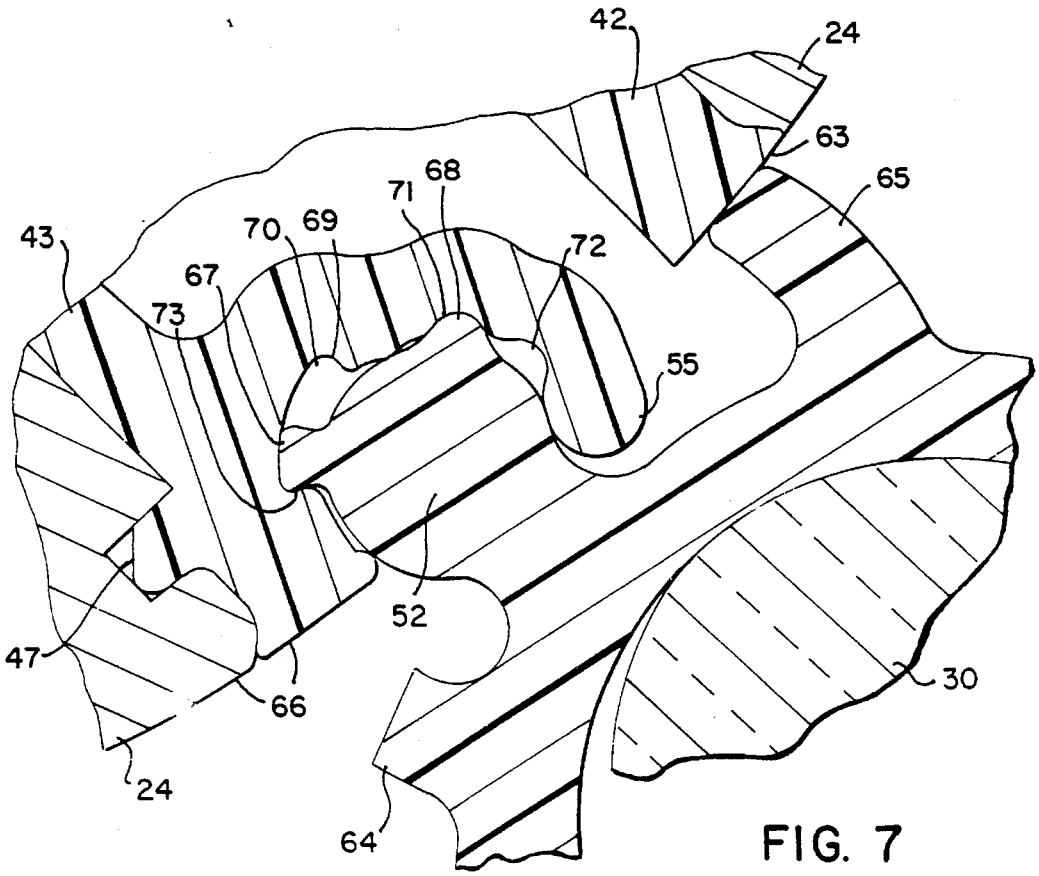

FIGS. 6 and 7 illustrate the frictional engagement or detent action between the projecting portion 52 and the compartment 54 of the door latching and seal assembly 10. It is seen that the projecting portion 52 has two projecting lobes 67 and 68 which engage in cutouts 70, 71 and 72 disposed in the compartment 54 of the mounting member 36. It is also seen that stop extensions 64 and 65 are provided on the latch and seal member 38 for respective contact with the intermediate post 24 and side wall 43 in one instance, and side wall 42 in another.

A better understanding of the door latching seal 10 will be had by a description of its operation. FIGS. 3 and 4 correspond to FIG. 6 in illustrating the position of the door latching and seal assembly 10, whereas FIG. 5 corresponds to FIG. 7.

Referring to FIGS. 3, 4 and 6, the latch and seal member 38 is in a receptive mode in conjunction with the door 30. Note that the angle of approach of the curved door 30 with respect to the post 24 of about 43°. This is measured from an extended radius of the post 24 and the directional arrow 75. The lobe 68 is positioned in the cutout 72, whereas the lobe 67 is seated against wall 69 of cutout 70. In this position, the stop extension 64 contacts the stop surfaces 66 on the intermediate post 24 and the side wall 43.

As the door 30 proceeds toward intermediate post 24, it contacts the lip 60 as shown in FIG. 4 and moves in the direction of the arrow 75 inwardly between the side walls 57 and 58. As it proceeds in this direction, it effects a pivoting counterclockwise motion of the latch and seal member 38 to ultimately move it into the position shown in FIGS. 5 and 7. It is seen that the lobe 67 has moved to engage the wall surface 73 in cutout 70 and lobe 68 has moved from cutout 72 to cutout 71. The door is now in a sealed and closed position.

To open the door 30, the previously described operation is reversed. Referring to FIGS. 5 and 7, as the door 30 is pivoted away from intermediate post 24 and the latch and seal member 38, it contacts the shorter side wall 57. This rotates latch and seal member 38 in a clockwise manner to move the latch and seal member back to the position shown in FIGS. 3 and 4. It should be pointed out that the previously described clockwise and counterclockwise motions are not only terminated by the detent action effected by the lobes 67 and 68, and the cutouts 70, 71 and 72, but also by the respective contact of the stop extensions 64 and 65 against the stop surfaces 63 and 66.

The mounting member 36 and the latch and seal member 38 are extruded from flexible and rigid vinyl plastic materials such as a flexible Geon 83457 and a rigid Geon 87256 plastic available from the B. F. Goodrich Co. The mounting member 36 is composed of the rigid Geon plastic, whereas the seal member 38 is coextruded from the flexible and rigid plastic with the major portion being rigid and the lip 60 being flexible. Other resilient and rigid materials could be employed as long as they provide sufficient displacement and resiliency to effect the previously described detent action.

It will thus be seen that the door latching and seal assembly of this invention affords a unique latching and seal. For repair or maintenance, it should be appreciated that the latch and seal member 38 can be easily removed from the mounting member 36 because of the snap fitment between the projecting portion 52 and the compartment 54 of the mounting member 36 as provided by the arm 55 of the mounting member 36 wrapping around projecting portion 52. In addition, the mounting member 36 can easily be installed or moved out of the intermediate post 24 by a vertical sliding action.

While a preferred embodiment has been described above, it should be readily apparent to those skilled in the art from this disclosure that a number of modifications and changes can be made without departing from the spirit and scope of the invention. For example, while a particular lip configuration 60 has been described, other configurations could be utilized to contact the door 30. Also, while a more efficient detent action is provided by using the stop extensions 64 and 65, these could be eliminated. However, these avoid excessive stress on the member wall. Neither is it necessary that the mounting member 36 be removable from the intermediate post 24. Also, the specific materials mentioned are not the only materials which can be used. All such and other modifications within the spirit of the invention are to be within the scope thereof.

I claim:

1. A door latching and seal assembly comprising:

a door panel pivotal on an essentially vertical axis;

an essentially vertical support;

a mounting member adapted to be secured to the essentially vertical support;

a combined latching and seal member pivotally attached to the mounting member for contact with the door panel; and resilient displacement means acting between the mounting member and the latching and seal member to provide a frictional engagement between the mounting member and the latching and seal member, the frictional engagement resisting pivoting of the latching and seal member away from two distinct positions.

2. A door latching and seal assembly comprising:

a door panel pivotal on an essentially vertical axis;

an essentially vertical support;

a mounting member adapted to be secured to the essentially vertical support;

a combined latching and seal member pivotally attached to the mounting member for contact with the door panel; and resilient displacement means acting between the mounting member and the latching and seal member to resist pivoting of the latching and seal member away from two distinct positions, the resilient displacement means being defined by a detent action.

3. The door latching and seal assembly of claim 2, wherein the resilient displacement means is in part defined by a projecting portion and a receptive compartment reciprocally positioned on the mounting member and the combined latching and seal member, the mounting member and the combined latching and seal member being constructed and arranged to provide a snap apart feature.

4. The door latching and seal assembly as defined in claim 2, wherein the detent action is provided by lobe portions and cutouts reciprocally positioned on the mounting member and the combined latching and seal member.

5. The door latching and seal assembly of claim 2, wherein the combined latching and seal member includes a base wall and two side wall members with one of the side wall members extending beyond and toward the other to provide a seal lip.

6. The door latching and seal assembly of claim 2, wherein the mounting member and the combined latching and seal member are extrusions, with the mounting member adapted to be slip fitted into a door jamb.

7. The door latching and seal assembly of claim 2, wherein the vertical support is a door jamb.

8. The door latching and seal assembly of claim 2, wherein the door jamb is rounded pole.

9. The door latching and seal assembly of claim 8, wherein the rounded pole forms a portion of a shower enclosure.

10. The door latching and seal assembly of claim 2, wherein the door panel is curved in horizontal section.

* * * * *

UNITED STATES PATENT AND TRADEMARK OFFICE

CERTIFICATE OF CORRECTION

PATENT NO. : 5,480,199

DATED : January 2, 1996

INVENTOR(S) : Thomas J. Husting

It is certified that error appears in the above-indentified patent and that said Letters Patent is hereby corrected as shown below:

Column 1, line 65 after "side." "The objects" should start a new paragraph.

Column 6, line 4 after "claim" "2" should be --7--.

Signed and Sealed this

Sixteenth Day of April, 1996

Bruce Lehman

BRUCE LEHMAN

*Commissioner of Patents and Trademarks*

*Attest:*

*Attesting Officer*